US005407051A

United States Patent [19]

Wohlrab

[11] Patent Number: 5,407,051

[45] Date of Patent: Apr. 18, 1995

[54] MOVABLE SWITCH FOR A COIN MACHINE

[75] Inventor: Ekhart Wohlrab, Stade, Germany

[73] Assignee: National Rejectors Inc GmbH, Buxtehude, Germany

[21] Appl. No.: 142,898

[22] Filed: Oct. 22, 1993

[30] Foreign Application Priority Data

Oct. 22, 1992 [DE] Germany ..... 42 35 652.0

[51] Int. Cl.[6] ..... G07F 1/04

[52] U.S. Cl. ..... 194/346

[58] Field of Search ..... 194/344, 346, 353

[56] References Cited

U.S. PATENT DOCUMENTS 4,838,406 6/1989 Leyasseur ..... 194/346

5,167,314 12/1992 Levasseur ..... 194/346

FOREIGN PATENT DOCUMENTS

0147112A2 7/1985 European Pat. Off. .

4001188A1 7/1990 Germany .

OTHER PUBLICATIONS

"ABC Technik ud Naturwissenschaft" article dated Dec. 15, 1970.

*Primary Examiner*—Michael S. Huppert

*Assistant Examiner*—Scott L. Lowe

*Attorney, Agent, or Firm*—Vidas, Arrett & Steinkraus

[57] ABSTRACT

The present invention relates to a movable switch for a coin machine comprising an electrically driven actuator for moving the switch element between at least two positions, in which the coins are selectively guided into one of at least two channels, wherein the actuator comprises a piezoelectric element deformable by a D.C. voltage which element is electrically connected to a D.C. source and is mechanically coupled to the switch element.

15 Claims, 2 Drawing Sheets

MOVABLE SWITCH FOR A COIN MACHINE

The present invention refers to a movable switch for a coin machine.

Coin switches are used for devices in which coins have to be checked and/or handled to selectively guide coins passing-by to different channels downstream of the coin switch. For example, it is required to return coins not accepted and to guide acceptable coins into the cash box or to a sorting means. Conventionally, the coin switches have pivotal flaps or slides to selectively block or release the passage for a coin.

Conventionally the coin switches of this type are usually actuated by an electromagnet. The electromagnet operates a movable armature to pivot or slide the coin switch when actuated. However, electromagnets have certain disadvantages. Their structure is relatively complicate, spaceconsuming and relatively heavy. Electromagnets further require at least a minimum energy for being actuated and operate relatively slow. In particular for pivotable coin switches a relatively complicate gear means is required to convert the translatery motion of the armature into a rotary motion.

SUMMARY OF THE INVENTION

It is the object of the present invention to provide a movable switch for a coin machine that can be actuated with less energy and which is built in using a few simple parts. According to the invention, the actuating means is defined by a piezoelectric element which is alternatively connected to a D.C. source and which is coupled to the switch. As known, piezo-crystals have the characteristic to spontaneously form electrical charges on their surfaces when being subjected to tension and pressure. Piezoelectric crystals also show a reciprocal behaviour, i.e. they become deformed when an electrical voltage is applied. Depending on the respective shape of the piezoelectric element and the location of the electrodes a tensioning or bending S-like deformation may be initiated. This feature is utilized for the invention. By applying a D.C. voltage, a deformation of the piezoelectric element is initiated. This deformation may be directly transmitted to operate the switch. According to an embodiment of the invention, the piezoelectric element is elongate and is subjected to a bending deformation in a transversal direction with respect to the longitudinal axis. The bending of the piezoelectric element may be transmitted to the switch and may be converted into a rotary motion.

To obtain a gentle actuation of the switch, a further aspect of the invention provides a switch made of plastic material which is linked to a stationary portion through a film hinge. A film hinge is free of wear and requires a very small energy when being moved.

A number of different embodiments is conceivable to transmit the deforming motion of the piezoelectric element to the switch to be actuated. According to an embodiment of the invention, the elongate piezoelectric element approximately extends in parallel to the rotational axis of the switch and a resilient element connected between the piezoelectric element and a fastening point of the switch extends approximately vertical to the rotational axis. A deformation of the piezoelectric element results in displacing the fastening point of the resilient element defining a swinging lever, and results in generating a moment acting on the switch which thus performs a pivotal motion until the swinging lever exerts its bias force on the switch substantially in the plane of the switch. It should be understood that the piezoelectric element rotates in the opposite direction when the polarization is reversed. To make the cinematics referred to as effective as possible, a further embodiment of the invention provides a structure in which the loose fastening point of the spring element at the piezoelectric element approximately coincides with the rotational axis of the switch. According to a still further embodiment of the invention, the resilient element is appropriately formed by a zig-zag shaped blade spring which has the further advantage that it can coact with an edge provided on the piezoelectric element or, respectively, the switch to provide for a loose support of the swinging lever independent of the position of the switch. The resilient element or the swinging lever is preferably located in a recess of the switch.

According to a further embodiment of the invention, the piezoelectric element can be housed in a stationary channel element extending approximately parallel to the axis of rotation, having a distance at least to the inner wall of the channel. Accordingly, the piezoelectric element can be deformed within the channel, for example it may perform a pivotal motion caused by being bent which motion is transmitted to the switch, for example through the swinging lever referred to. The channel element may be fixed by stationary projections protruding into the ends of the channel element.

As referred to above, one end of the piezoelectric element can be fixed, whereas the deformable free end transmits its motion to the switch. In this combination, the invention provides for a further embodiment according to which the piezoelectric element is inserted into a deformable bushing which is press-fit in a recess of the apparatus to fix the end of the piezoelectric element. Those elements are relatively sensitive and brittle as it is known. The piezoelectric element is protected and safely supported by a relatively soft bushing.

According to an alternative embodiment of the invention, the ends of the piezoelectric element can be received in recesses of the apparatus, and the element is longitudinally movable to a limited extent. In this way the piezoelectric element may be subjected to a central bending. The changes in length occuring between the bent condition and the straight condition are to be compensated for by the recesses. To provide for a protection of the piezoelectric element also in this embodiment, the element may be surrounded by a channel element. In this case, however, this channel element is deformable as well and its bending is coupled to the preferably pivotally supported switch. It is a particular advantage to form the switch and the channel element integrally from plastic material. Therebetween there is at least a foil hinge.

The switch according to the invention offers the particular advantage that the deformation of the piezoelectric element is directly utilized to a move the switch eliminating any gear means therebetween. The actuation is performed very fast and requires minimum energy. Since relatively low currents are required, controlling the piezoelectric element is facilitated. When the element is not energized, stable end positions will be obtained since a static condition is obtained.

The aforegoing and other objects, features and advantages of the present invention will be become appearant in the light of the following detailed description of an exemplary embodiment thereof as illustrated in the accompanying drawing.

Figure 1:
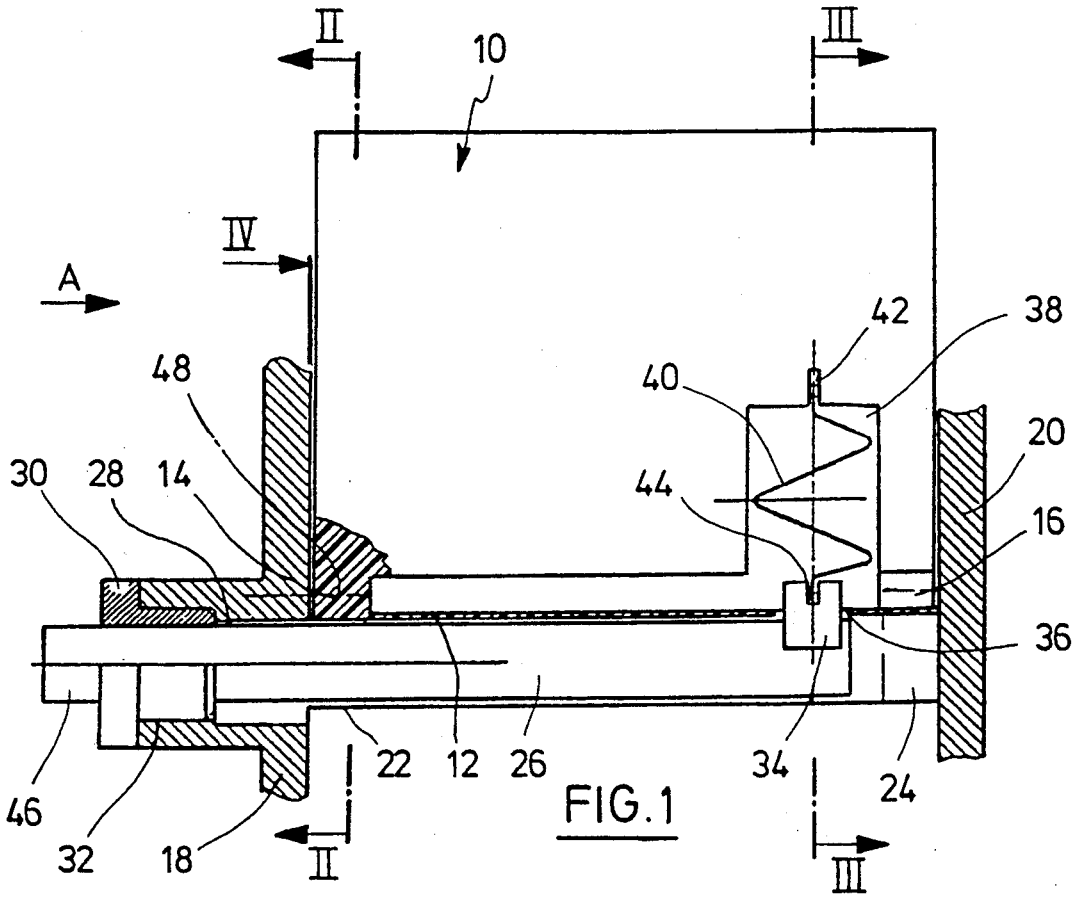
FIG. 1 is a schematic view of a coin switch according to the invention.
Figure 2:
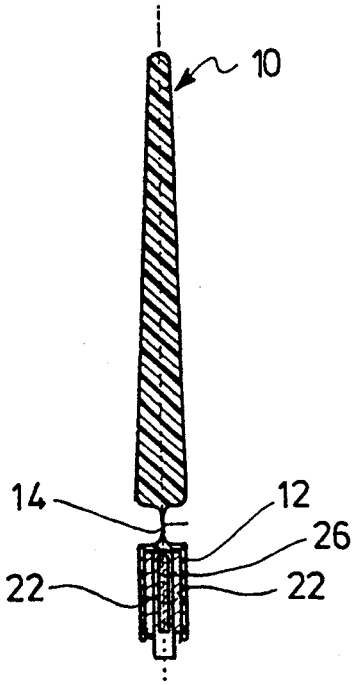
FIG. 2 is a sectional view through FIG. 1 along line 2—2.
Figure 3:
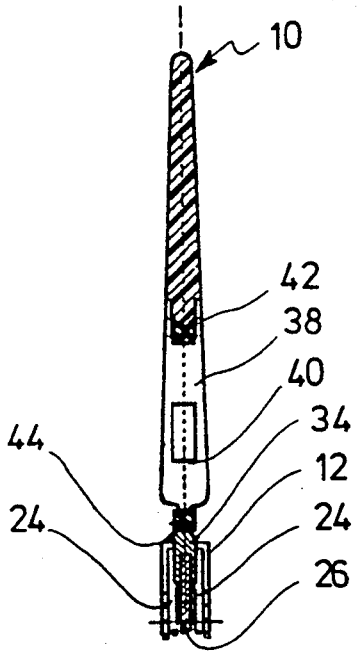
FIG. 3 is a sectional view through FIG. 1 along line 3—3.
Figure 4:
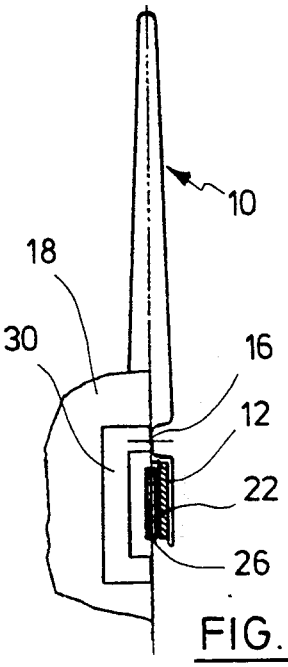
FIG. 4 is a sectional view through FIG. 1 along line 4—4 in the direction A.

A switch member 10 made of plastic material is integrally formed with an inverse U-shaped channel element 12, wherein the junction between the members 10 and 12 is provided by a pair of distant film hinges 14, 16. The casing of a coin machine (not shown) includes portions 18 und 20. For example, the switch element 10 is located at the end of a coin track section above two or more channels into which the coins are to be guided by the switch 10.

The casing 18, 20 includes sidewardly projecting lugs 22 and 24 extending from the ends into the channel element to fix it. A strip-like piezoelectric element 26 having a rectangular cross-section is approximately centrally located within the channel, which element extends from the left casing portion 18 up to approximately the right casing portion 20, but ends at a certain distance from the lugs 24, as shown in FIG. 1. The piezoelectric element extends through an aperture 28 in the casing as well as through a bushing 30 of deformable material, having a rectangular cross-section which bushing is press-fit in a correspondingly profiled enlarged aperture 32 of the casing portion 18. Thus, the piezoelectric element 26 is shielded and safely fixed to the casing portion 18. The effective length of the element 26 begins at the outlet of the bushing 30. An edge-shaped element 34 is mounted to ride on the upper side of the element 26, relatively close to its free end, which element 34 extends through an aperture 36 of the channel element 12. The switch member 10 has a corresponding recess 38 to accomodate a zig-zag shaped blade spring 40. The bottom of the recess 38 includes an edge-shaped profile 42 and the edge-shaped element 34 has a similar profile at 44. The ends of the blade spring 40 are provided with V-shaped cuts cooperating with the edge-shaped portions 42 and 44.

A D.C. voltage is applied to the piezoelectric element 26 at 46. The electrodes are not shown.

Figure 5:
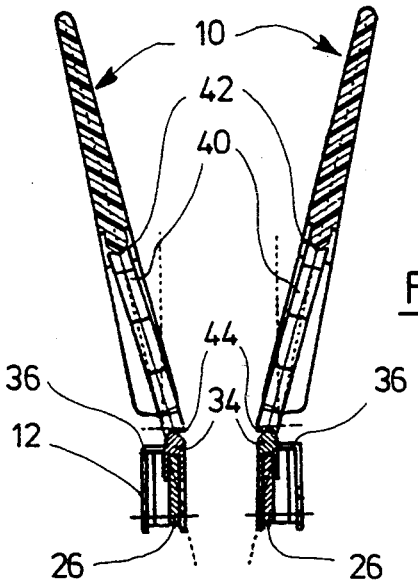
FIG. 5 shows two different positions of the switch according to FIG. 3.

The piezoelectric element 26 is selected such that it is subjected to a bending deformation when the D.C. voltage is applied such that the piezoelectric element 26 pivots to one or the other side in the channel section 12 in response to the polarity of the D.C. voltage. This is shown in FIG. 5. Accordingly, the edge-shaped element 34 is sidewardly displaced driving the blade spring 40 acting as a swinging lever. The element 42 transmits a moment to the switch element 10 to pivot the latter until balance is renewed. The torque produced results from the fact that the distance between the edge 42 and the axis of rotation as shown at 48 is always constant, whereas the distance between the edges 42, 44 is varied when the piezoelement 26 is subjected to deformation.

Figure 6:
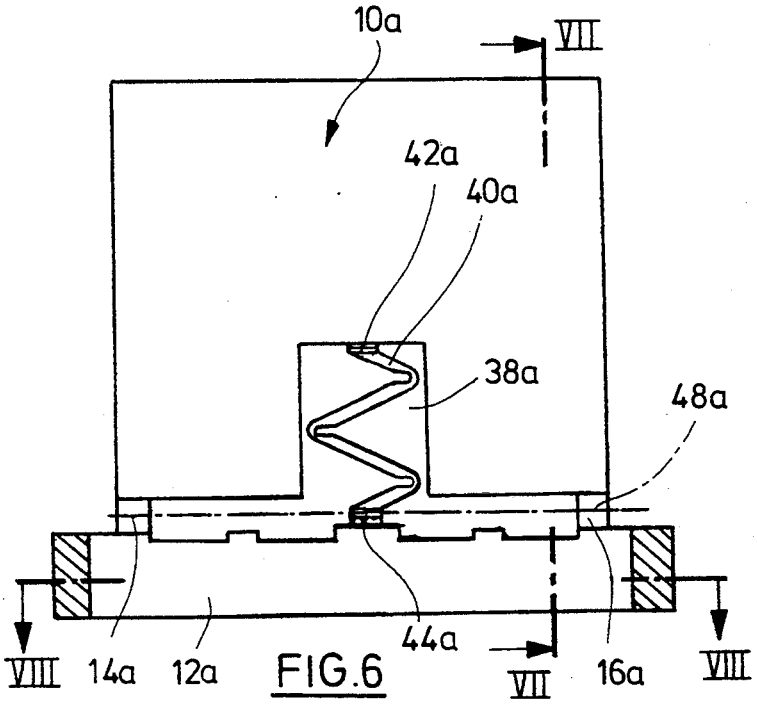
FIG. 6 is a schematic side view of a further embodiment of a coin switch according to the invention.
Figure 7:
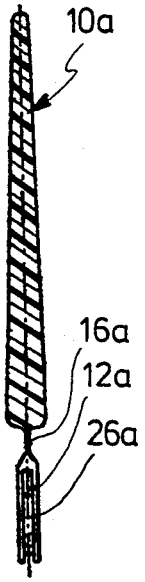
FIG. 7 is a sectional view through FIG. 6 along line 7—7.
Figure 8:
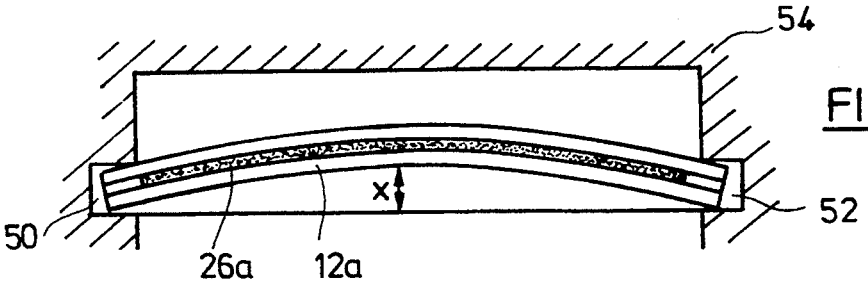
FIG. 8 is a sectional view through FIG. 7 along line 8—8.

In the following description of the embodiment according to FIGS. 6 to 8 all components corresponding to the embodiment of FIGS. 1 to 5 carry the same reference numerals to which a supplemental index a has been added.

A switch element **10*a* is integrally formed with an inverse U-shaped channel section 12*a* through film hinges 14*a*, 16*a*. An elongate piezoelectric element 26*a* having a rectangular cross-section is fit in the channel section 12*a*. The switch element 10*a* includes a recess 38*a* in which a swinging lever made of plastic material is connected to the switch element 10*a* and to the channel element 12*a* through film hinges 42*a* and 44*a***.

The ends of the channel sections **12*a* are located in apertures 50, 52 in a portion 54 of the casing (not shown). When a D.C. voltage is applied to the piezoelectric element 26*a* it is bent, wherein the maximum deforming distance is indicated as "x" (FIG. 8). This deformation results in a dis-placement of the film hinge 44*a*** and accordingly a similar rotary motion is produced as explained for the embodiment above referred to.

I claim:

1. A switch for a coin machine, comprising a switch element rotatable about an axis in order to be moved between at least two positions in which the coins are selectively guided into one of at least two channels, actuating means for said switch element including an elongated piezoelectric element having a longitudinal axis, said piezoelectric element being subject to a bending deformation transverse to said longitudinal axis if a DC voltage is connected to said piezoelectric element, said piezoelectric element extending approximately parallel to said axis of rotation, and further comprising a resilient element located between said piezoelectric element and a junction point of said switch element, said resilient element extending substantially perpendicular to said axis of rotation and permanently exerting a force on said switch element.

2. The switch of claim 1, wherein the switch element is made of plastic material and is hinged via a film hinge to a housing portion.

3. The switch of claim 1, wherein the junction point of the resilient element engages said piezoelectric element approximately coincides with the axis of rotation of said switch element.

4. The switch of claim 1, wherein the resilient element has a relatively high geometrical moment of inertia transverse to its longitudinal axis.

5. The switch of claim 1, wherein the resilient element is defined by a zig-zag-shaped blade spring.

6. The switch of claim 1, wherein the resilient element is arranged in a recess of the switching element.

7. The switch of claim 1, wherein the resilient element is mounted to the piezoelectric element or the switch element through a edge-shaped element.

8. The switch of claim 1, wherein the resilient element is connected to the piezoelectric element or the switching element through film hinges.

9. The switch of claim 1, wherein the ends of the piezoelectric element are received in apertures of the casing and are supported longitudinally at a limited extent.

10. The switch of claim 1, wherein one end of the piezoelectric element is fixed.

11. The switch of claim 10, wherein the piezoelectric element is inserted in a deformable bushing which is press-fit in an aperture of the casing to fix the end of the piezoelectric element.

12. The switch of claim 1, wherein the piezoelectric element is located in a stationary channel section extending approximately parallel to the axis of rotation and the piezoelectric element having a distance at least to one inner wall of the channel.

13. The switch of claim 12, wherein the channel element opening downwardly includes an aperture in a bottom of the channel through which the resilient element extends.

14. The switch of claim 12, wherein the channel element is fixed by stationary projections which protrude into the ends of the channel element.

15. The switch of claim 12, wherein the switch element and the channel element are integrally formed of plastic material.

* * * * *

UNITED STATES PATENT AND TRADEMARK OFFICE

CERTIFICATE OF CORRECTION

PATENT NO. : 5,407,051

DATED : April 18, 1995

INVENTOR(S) : WOHLRAB, EKHART

It is certified that error appears in the above—identified patent and that said Letters Patent is hereby corrected as shown below:

Col. 4, line 63, delete "at" and insert -- to --

Signed and Sealed this

Eleventh Day of July, 1995

Bruce Lehman

*Attest:*

BRUCE LEHMAN

*Attesting Officer*

*Commissioner of Patents and Trademarks*